US006411258B1

(12) United States Patent
Ho

(10) Patent No.: US 6,411,258 B1
(45) Date of Patent: Jun. 25, 2002

(54) PLANAR ANTENNA ARRAY FOR POINT-TO-POINT COMMUNICATIONS

(75) Inventor: Jimmy Ho, Fife (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/688,521

(22) Filed: Oct. 16, 2000

(51) Int. Cl.[7] ..... H01Q 1/38
(52) U.S. Cl. ..... 343/700 MS; 343/770
(58) Field of Search ..... 343/700 MS, 767, 343/770, 829, 846, 853; H01Q 21/24, 1/38

(56) References Cited

U.S. PATENT DOCUMENTS 4,857,938 A * 8/1989 Tsukamoto et al. .. 343/700 MS
4,977,406 A * 12/1990 Tsukamoto et al. .. 343/700 MS
5,181,042 A * 1/1993 Kaise et al. ..... 343/700 MS
5,270,721 A * 12/1993 Tsukamoto et al. .. 343/700 MS
5,453,751 A * 9/1995 Tsukamoto et al. .. 343/700 MS

* cited by examiner

*Primary Examiner*—Tho Phan
(74) *Attorney, Agent, or Firm*—Jenkens & Gilchrist

(57) ABSTRACT

A planar antenna array for linearly polarized waves is proposed which offers a technique of improving the radiation pattern of the antenna by compensating for amplitude and phase imbalance due to coupling between adjacent lines in the feed network. This imbalance causes the radiation patterns to be severely distorted. The proposed configuration uses slots offset in certain parts of the array and then bonds the slots to an aperture/waveguide layer and produces an antenna with good gain, good match over a wide frequency band and good cross polar discrimination as well as providing an improvement in the overall radiation pattern of the antenna.

19 Claims, 5 Drawing Sheets

PLANAR ANTENNA ARRAY FOR POINT-TO-POINT COMMUNICATIONS

FIELD OF THE INVENTION

The invention concerns antenna design, and more particularly, a planar antenna array for point-to-point communication which compensates for amplitude and phase imbalance in its feed network.

BACKGROUND OF THE INVENTION

In an antenna array using patch and microstrip antenna structure, amplitude and phase errors or discrepancies commonly occur from one radiating element or patch to the next in the array. For example, the feed network and radiating patches are typically carried on thin substrates such that the fields which are generated are not confined within the substrate but will radiate considerably. Thus, coupling between adjacent feedlines, adjacent patches, etc. can cause considerable amplitude and phase imbalances in the power distribution network. Such imbalances can result in undesirable radiating pattern characteristics. The present invention concerns a method and structure for compensating for such phase and/or amplitude imbalance in the feed network.

OBJECTS OF THE INVENTION

Accordingly, it is a general object of the invention to provide an improved planar antenna array for point-to-point communications.

A more specific object is to provide a planar array antenna design which compensates for amplitude and balance in its feed network.

SUMMARY OF THE INVENTION

A planar antenna for point-to-point communications comprises a conductive backplane having a planar conductive surface, a generally planar feed and radiating network parallel to and spaced above the backplane surface, a generally planar slot level parallel to and adjacent said feed and radiating the network layer, and a planar aperture layer parallel and adjacent said slot layer, the aperture layer being bonded to the slot layer.

DETAILED DESCRIPTION OF THE ILLUSTRATED EMBODIMENT

Figure 9:
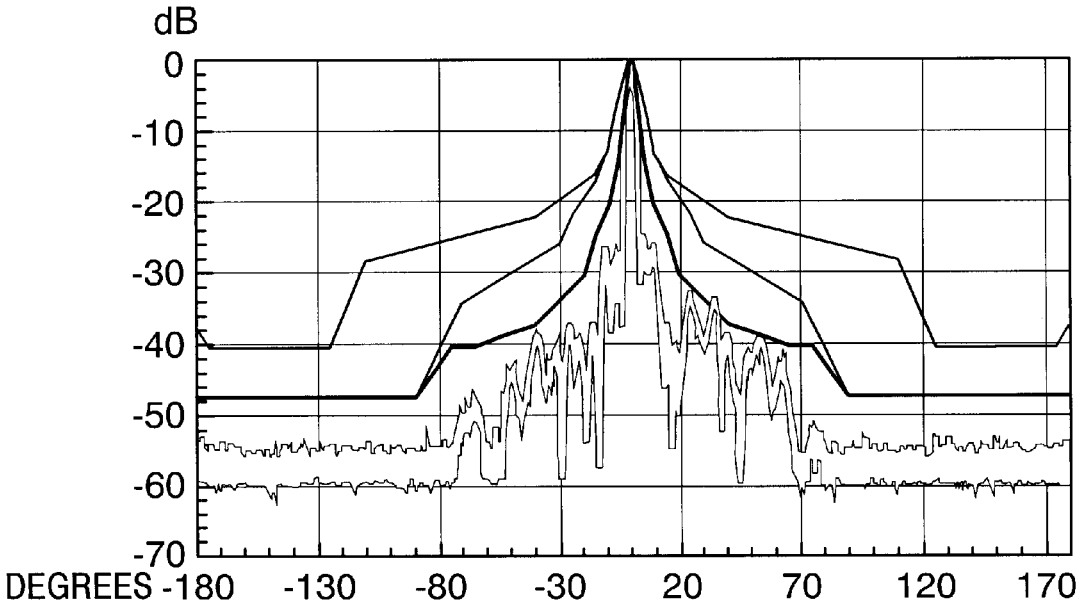
FIG. 9 is a plot of the radiation pattern for a compensated 16×≠array in accordance with the invention.

In the description which follows, antenna array architecture (FIG. 1), and reasons for using variable slots within the aperture/waveguide are described. The usefulness of the invention is demonstrated by the measured radiation pattern (FIG. 3) from an initial prototype array known to have very poor amplitude and phase distribution within the feed network circuitry. Despite this very large amplitude and phase imbalance, FIG. 4 illustrates how the use of variable slots within a given aperture/waveguide in accordance with the invention resulted in improvements in the radiation pattern of the array. In a second prototype array, the design of variable slots within the aperture/waveguide in accordance with the invention resulted in even better phase and amplitude response as shown in FIG. 5 and FIG. 9.

Figure 1:
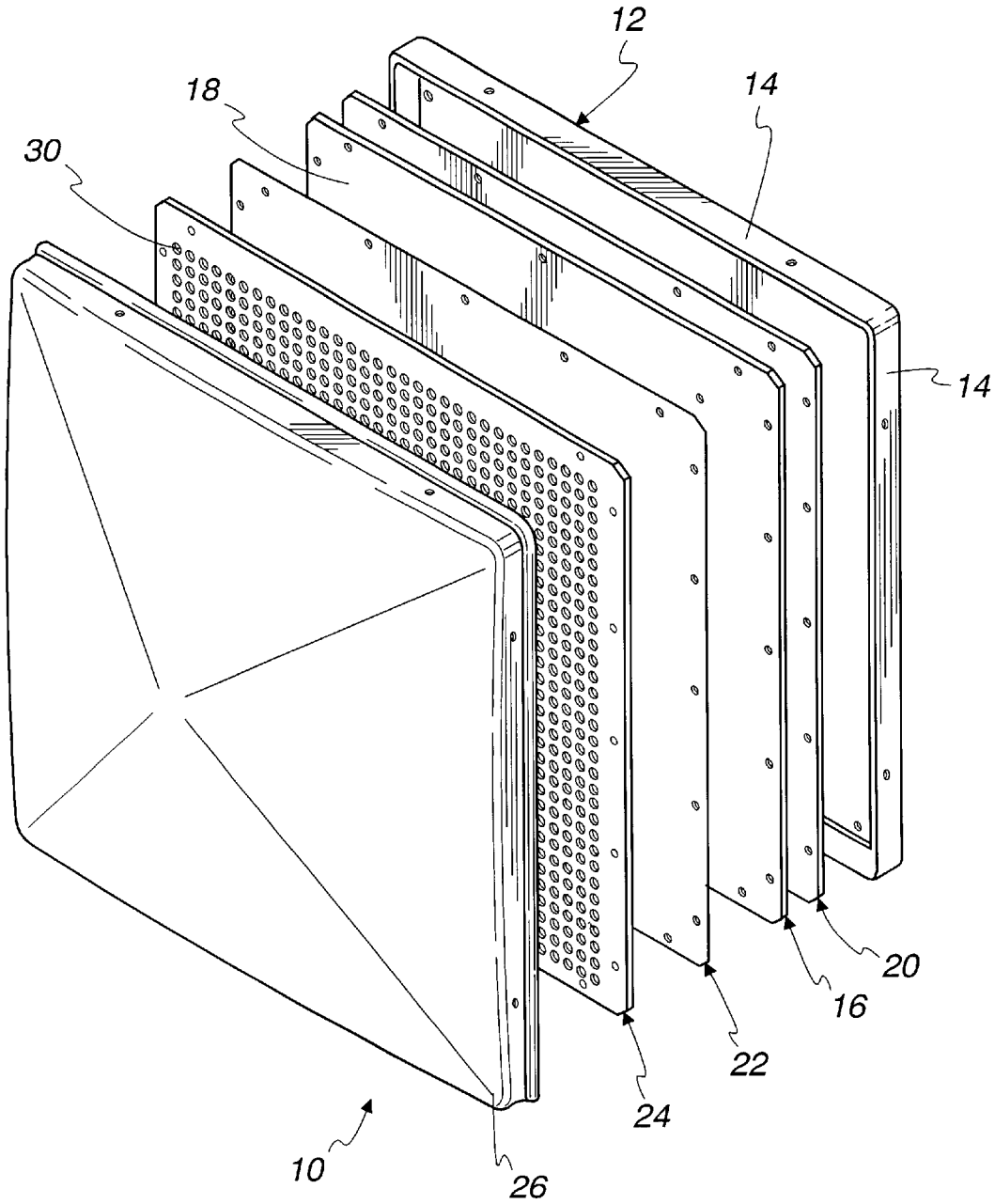
FIG. 1 is an exploded view of planar antenna array.

Referring to FIG. 1, an antenna array 10 has a ground plane 12 with the sides 14 turned up to act as a shield. A feed and radiating (patch) network 18 is constructed on microwave flex material 16 suspended above a foam layer 20 having a dielectric constant close to air. Electromagnetic coupling to a slot layer 22 and an aperture/waveguide plate or layer 24 is utilized to enhance the bandwidth of the array. A radome cover 26 attaches to the ground plane 12 and covers the above-described elements.

Because the feed and patch layer is designed on a thin substrate suspended on an "air" dielectric, the fields are not confined within the substrate and as a consequence will radiate considerably. With the element spacing restricted due to grating lobe consideration, coupling between adjacent lines causes severe amplitude and phase imbalance in the power distribution network and as a consequence will result in very poor pattern characteristics. In addition, radiation from discontinuities will also contribute.

Figure 2:
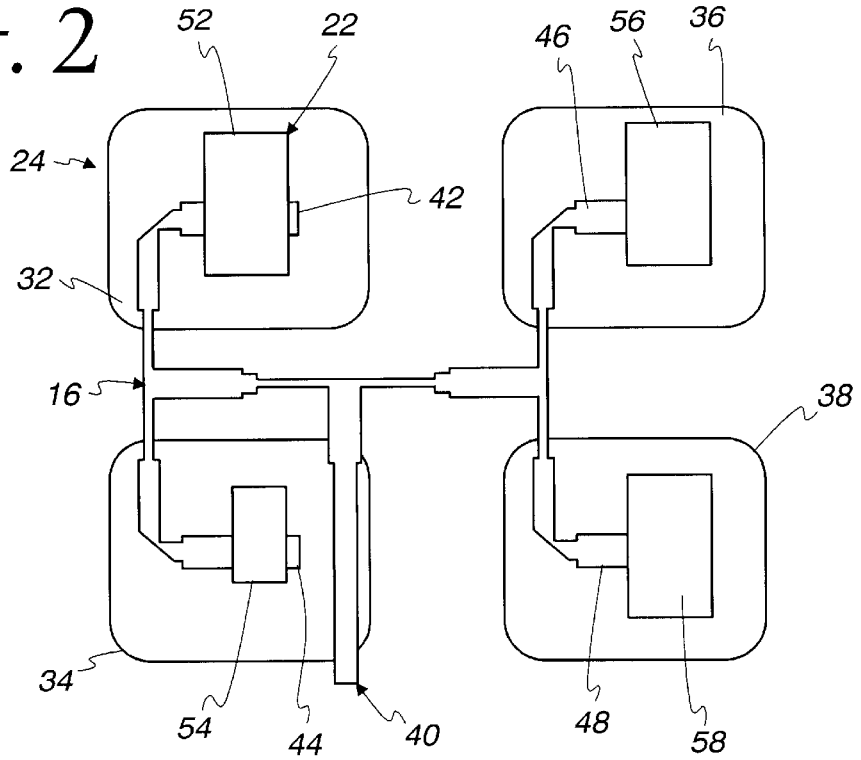
FIG. 2 illustrates a modified slot design in accordance with the invention.

FIG. 2 illustrates the principles of the invention, wherein at least some slots are offset within the aperture/waveguide in order to equalize the amplitude and phase imbalance due to coupling between adjacent lines. The slots are moved in accordance with their amplitude and phase distribution. The size and/or shape of each slot can also be changed to achieve the desired result. That is, any or all of slot shape, size and position can be changed to compensate for the feed network amplitude and phase imbalance due to coupling between adjacent lines. The feed and aperture/waveguide remain fixed. Size, shape and/or positional change in the slots is all that is required to compensate for this imbalance.

In FIG. 2, the structure of FIG. 1 is viewed through a 2×2 array or sub-set of the apertures 30 in the aperture layer or plate 24. In FIG. 2, the respective apertures 30 are designated by reference numerals 32, 34, 36 and 38. In this regard, FIG. 2 is a somewhat diagrammatic view, in that it shows only the respective apertures 32, 34, corresponding slots in the slot layer 22, and corresponding parts of the feed network and radiating patches of the layer 18 of FIG. 1.

In this regard, a portion of the feed network is designated in FIG. 2 by the reference numeral 40. Respective radiating patches 42, 44, 46 and 48 are illustrated in connection with the corresponding apertures 32, 34, etc. Also, the corresponding slots of the slot layer 22 are designated by reference numerals 52, 54, 56 and 58. It will be seen with respect to the slots 52, 56 and 58 that these have been offset to different relative positions relative to their corresponding radiating elements 42, 44, etc. and their respective aligned apertures 32, 34, etc. With respect to the slot 54, the size of this slot has been changed in accordance with the invention. The size and positional changes of the slots are to compensate for imbalance in the network, as mentioned above.

The slot layer 22 and the aperture/waveguide layer 24 are bonded together to create a very thin composite layer that results in good gain for the array, good return loss and good cross polar discrimination. Bonded in this way, the layer of slots can be kept flat and aligned accurately to the apertures/waveguide. This eliminates tolerancing problems can be acute at millimeter-wave (mm-wave) frequencies. This also eliminates the need to equalize the amplitude and phase in the feed network; specifically, with space being a key restriction, compensation of amplitude and phase in the feed network would be quite difficult. Hence the bonding of the slot circuit to the aperture/waveguide, together with offsetting (certain) slots to compensate for the amplitude and phase imbalance resulting from coupling between adjacent lines provides an effective mechanism for compensation.

For purposes of giving a complete example of an antenna structure, various elements and characteristics of the parts thus far described in one embodiment of the invention are given. It will be understood that variations in the structural components may be utilized without departing from the invention. The ground plane 12 and the aperture plate 24 may be constructed of aluminum, with the aperture plate being about 2.5 mm thick. The foam layer 20 is an extruded polyethylene foam with a thickness of 1.5 mm. A suitable foam is available from Advanced Materials Ltd. of Newhall, Naas, County Kildare, Ireland, under the designation AMLTE2001.5 White.

The feed network or circuit 18 on the layer 16 is formed or etched in a copper layer carried on the dielectric substrate. In the illustrated embodiment, this is an 18 micron copper layer on a 50 micron substrate, available for, example, from Dupont under the designation Pyralux AP8525.

The slot layer 22 may be formed by etching apparent appropriate slots of the appropriate size, shape and position relative to the radiating elements of the feed circuit and the apertures 30, on a copper covered dielectric substrate. In the illustrated embodiment, a 35 micron copper layer is used on a 50 micron substrate of polyester. An additional polarizer layer, formed on a sheet of polyester 75 micron substrate with 35 micron copper coating, (not shown) may also be used, if desired, to operate with the antenna between the aperture layer 30 and the inside of the radome cover 26, rotated 45° from the principal planes.

The radome 26 may be constructed of a dielectric material such as one sold under the trademark LUSTRAN ABS. This material is polyacylontrile-butudience-styrene (ABS), also sold under trademarks: CYCOLAC, NOVODUR, and LUSTRAN is available from RONFALIN.

In one embodiment, all of the slots are of the same dimensions with the relative offset of slots being used to accomplish the desired corrections. In this embodiment, the slot dimensions have a width of 2.8 mm, a length of 6 mm and a corner radius of 1 mm. The slot layer is bonded to the aperture layer by spraying the aperture layer with an adhesive such as 3M spraymount, available from 3M UK, 3M House Brackenell, Burks, UK RG121JU.

Figure 3:
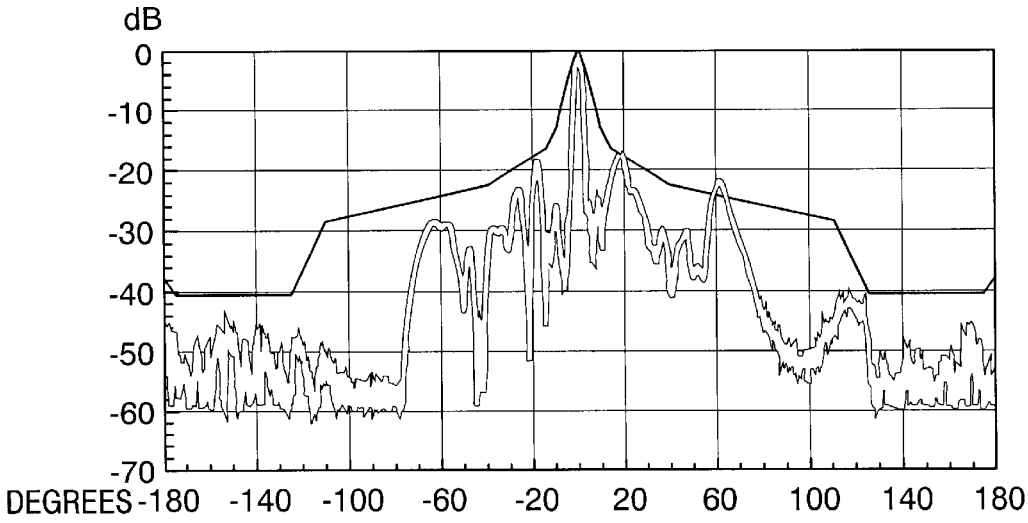
FIG. 3 is a plot of a radiation pattern for a 16×≠prototype array.
Figure 4:
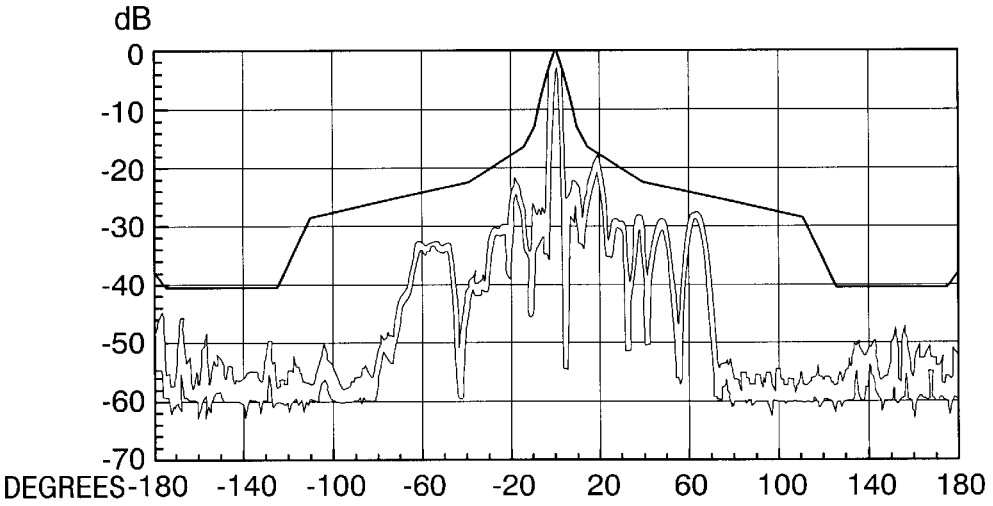
FIG. 4 shows a plot of a radiation pattern for a 16×≠array as in FIG. 4 wherein certain slots were offset in accordance with their amplitude and phase imbalance.
Figure 5:
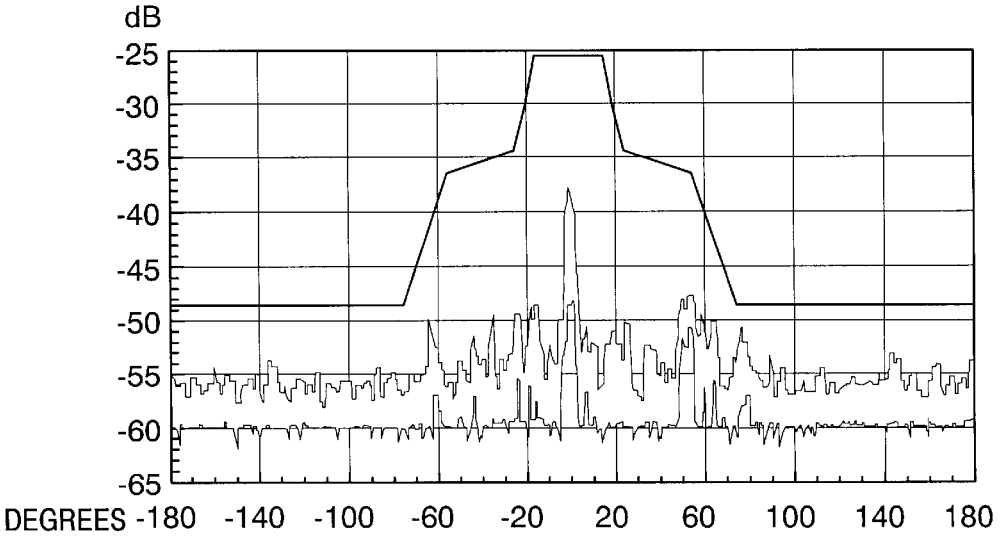
FIG. 5 shows a plot of a cross polar discrimination pattern for a 16×≠array using offset slot design in accordance with the invention.

The measured H-plane co-polar radiation patterns of the initial prototype antenna are shown in FIGS. 3 and 4. FIG. 3 shows a 16×≠array prototype with no slot offsets. FIG. 4 shows the 16×≠prototype with selected ones of the slots offset in accordance with their amplitude and phase imbalance.

Despite the very large amplitude and phase error inherent in the circuit, the effectiveness of offsetting certain selected slots was apparent as shown by the improvement in the radiation patterns shown in FIGS. 3 and 4.

To examine the phase and amplitude of the array, one array having straight (i.e., not offset) slots and another array having offset slots in certain parts of the array were used. Each antenna was probed and the amplitude and phase of each aperture/waveguide was recorded. Based on these measurements, we have found that controlling the amplitude and phase distribution through movement of the slot relative to the aperture/waveguide can be achieved without undue difficulty.

Figure 6:
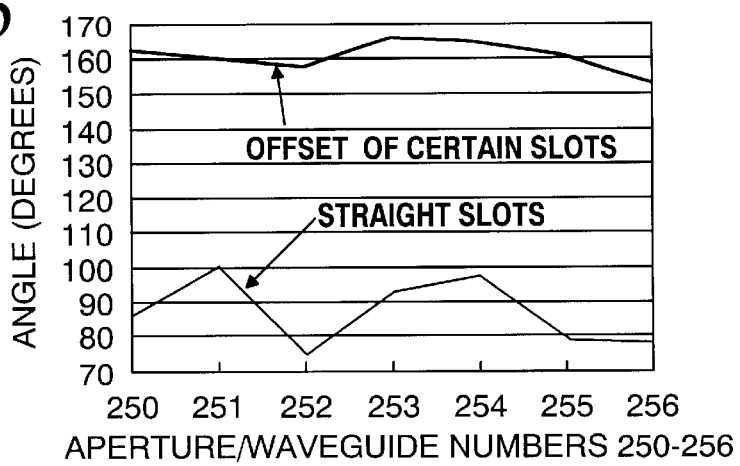
FIG. 6 is a plot showing phase variation from aperture/waveguide numbers 250–256 of the array.
Figure 7:
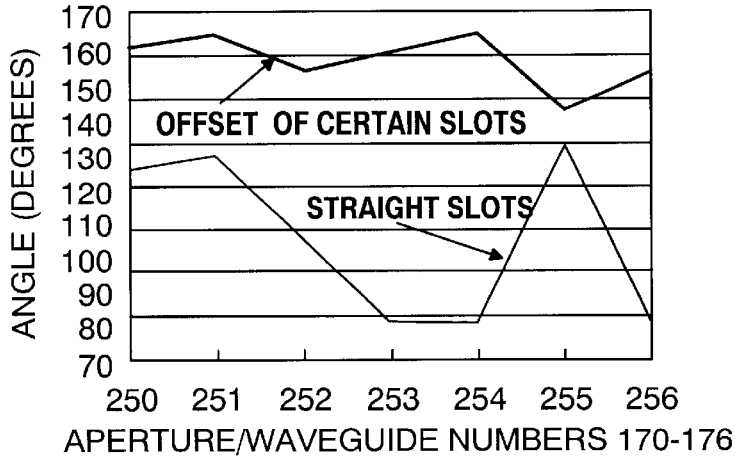
FIG. 7 is a plot showing phase variation from aperture/waveguide numbers 170–176 of the array.

FIGS. 6 and 7 show the phase response after probing a number of apertures/waveguides in the 16×≠array. With no offset of the slots ("straight slots"), the phase appears quite variable. This was predictable as the network was designed to be very simple and coupling between adjacent lines and nearby surroundings in the array was inevitable.

On the periphery of the antenna, the phase variation is expected to be minimal since discontinuities from the immediate surroundings can be neglected and any error is due to inadequate compensation in the feed circuit. FIG. 6 shows the discrete phase measurement for aperture/waveguide numbers 250–256 counting from left to right starting at the top left hand corner. That is, these are the last 7 elements in the 16×≠array.

FIG. 7 show the discrete phase measurements for aperture numbers 170–176 in the array. As can be seen, the phase varies considerably from one aperture to the next.

From the plot, we find that the maximum phase variation is reduced from, on average, 40° to 15°, by offsetting at least selected slots.

Figure 8:
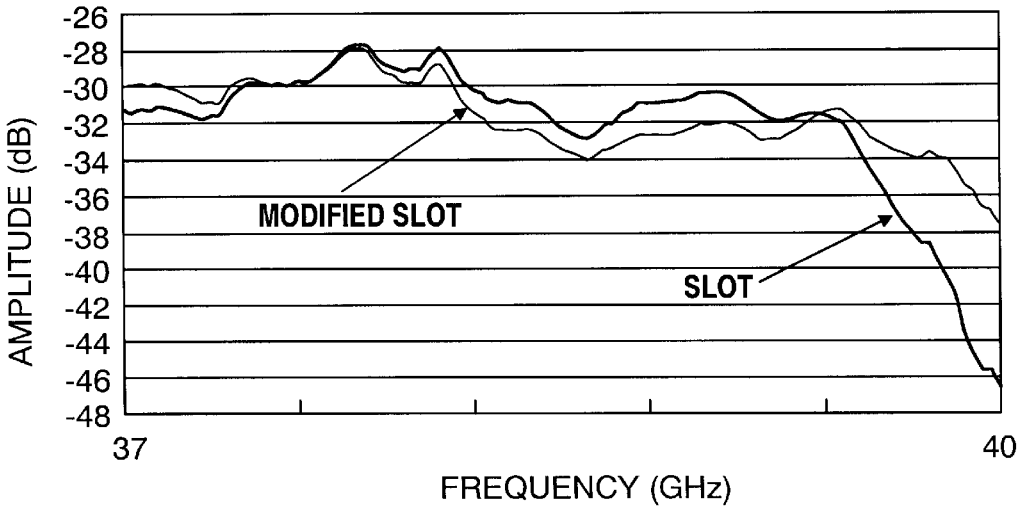
FIG. 8 is a plot of the measured amplitude response across the frequency band for aperture number 151 of the array.

Amplitude variation within the array can also be controlled. Again as in the phase response, amplitude response also varies from one aperture/waveguide to the next. The amplitude response is quite flat around the periphery of the array but gets worse towards the center of the array. In certain aperture/waveguides, a large loss in power at certain frequencies (particularly at the high end of the band) occurs. Referring to FIG. 8, the results show a sudden fall in one of the apertures at the top of the operating band. This is probably due to coupling to the nearby feed lines. By changing the size and/or shape of the slot within the aperture, the result is improved considerably as shown by the trace marked "Modified Slot".

When using uniform slots, the phase errors were found to be on average 40° out between one slot and the next. Offsetting certain slots to compensate for this error gave a flatter response throughout the array. The resultant radiation pattern is shown in FIG. 9. As can be seen by comparison to FIGS. 3 and 4, the offset slots bonded to an aperture/waveguide layer show remarkable improvements. This antenna design also show very good cross polarization discrimination with good match across the band. FIG. 5 shows a typical measured cross polarization discrimination of a 16×≠array using offset slots, in accordance with the invention, bonded to an aperture/waveguide layer.

The radiation patterns of FIGS. 3–5 and 9 are drawn against European Telecommunications Standard ETS300 833 Class1, Class2 and Class3.

Thus, offsetting the slots as described above has the effect of compensating for phase imbalance, and to an extent, amplitude imbalance. If the feed network does not show a large unexpected loss in power due to coupling from surrounding lines, the slot offset alone provides enough compensation. However, when a large or unexpected loss is encountered, the slot size and/or size and shape can also be changed to compensate for this loss in accordance with the present invention. The offset of a given slot can be determined from an equation based on the measured phase imbalance or phase offset of a given aperture. Using an approximation that one wavelength is equivalent to 360°, and the difference in phase between offset and non-offset slots in the prototype array, a conversion can be calculated from degrees to millimeters using a formula derived generally as follows.

Given:

1 wavelength ($\lambda$)=360 degrees

In a dielectric medium, $\lambda/\sqrt{\epsilon_r}=360$ $\lambda$=free space wavelength Given:

At a midband frequency of 38.5 GHz, $1\lambda=(3\times10^8)/(38.5\times10^9)=$ 7.792 mm Polyester slot circuit material properties:

Dielectric constant $\epsilon_r=3.3$

Therefore:

$\lambda=360(\sqrt{\epsilon_r})$ $7.792=360(\sqrt{3.3})$ 1 mm=360(1.8166)/(7.792)=83.929°

For example, if it is determined (from a simulator) that the phase error is approximately 17°, the distance that the slots in error needed to offset is approximately 17/83.929=0.2 mm, etc. Of course, this result would vary for other frequencies.

The benefit of varying the slots within a fixed aperture/waveguide to control the amplitude and phase response of the antenna can be demonstrated herein through both probing (e.g., by probing each aperture with a dipole) and radiation pattern measurements. By showing the radiation pattern of an array where the amplitude and phase in the feed circuit is known to be very poor, we have demonstrated a pattern improvement in the modified slot design. When the array was compensated so that the amplitude and phase errors were as minimal as possible, the patterns improved considerably. The technique provides a very simple method of controlling the amplitude and phase distribution throughout the array.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A planar antenna for point-to-point communications, comprising:

a conductive backplane having a planar conductive surface;

a generally planar feed and radiating network layer parallel to and spaced above said backplane surface;

a generally planar slot layer parallel to and adjacent said feed and radiating network layer; and a planar aperture layer parallel and adjacent to said slot layer, said aperture layer being bonded to said slot layer, wherein said feed and radiating network layer has a plurality of radiating elements arranged in an array, wherein said aperture layer has a plurality of apertures arranged in an array and respectively aligned with corresponding ones of said radiating elements and wherein said slot layer has a plurality of slots respectively aligned with corresponding ones of said radiating elements and corresponding ones of said apertures, and wherein said slots are configured and arranged relative to said radiating elements so as to compensate for at least one of amplitude errors and phase errors.

2. The antenna of claim 1 wherein said slots are configured and arranged so to compensate for amplitude and phase error by selecting at least one of slot size, slot shape and slot position of one or more of said slots relative to said radiating elements.

3. The antenna of claim 1 and further including an air dielectric layer interposed between said backplane and said feed and radiating network layer.

4. The antenna of claim 3 and further including a radome overlying said aperture layer, said slot layer and said feed and radiating network layer.

5. The antenna of claim 1 and further including a radome overlying said aperture layer, said slot layer and said feed and radiating network layer.

6. A planar antenna for point-to-point communications, comprising:

a conductive backplane having a planar conductive surface;

a generally planar feed and radiating network layer parallel to and spaced above said backplane surface;

a generally planar slot layer parallel to and adjacent said feed and radiating network layer, wherein said feed and radiating network layer has a plurality of radiating elements arranged in an array; and a planar aperture layer parallel and adjacent to said slot layer;

wherein said feed and radiating network layer has a plurality of radiating elements arranged in an array, wherein said aperture layer has a plurality of apertures arranged in an array and respectively aligned with corresponding ones of said radiating elements and wherein said slot layer has a plurality of slots respectively aligned with corresponding ones of said radiating elements and corresponding ones of said apertures and wherein said slots are configured and arranged relative to said radiating elements so as to compensate for at least one of amplitude errors and phase errors.

7. The antenna of claim 6 wherein said slots are configured and arranged to compensate for amplitude and phase error by selecting at least one of slot size, slot shape and slot position of one or more of said slots relative to said radiating elements.

8. The antenna of claim 7 and further including a radome overlying said aperture layer, said slot layer and said feed and radiating network layer.

9. The antenna of claim 7 and further including an air dielectric layer interposed between said backplane and said feed and radiating network layer.

10. The antenna of claim 7 and further including a radome overlying said aperture layer, said slot layer and said feed and radiating network layer.

11. A method of compensating for errors in a radiating array for point-to-point communications, said array including a conductive backplane having a planar conductive surface, a generally planar feed and radiating network layer parallel to and spaced above said backplane surface, a generally planar slot layer parallel to and adjacent said feed and radiating network layer, and a planar aperture layer parallel and adjacent said slot layer, said method comprising:

bonding said aperture layer to said slot layer;

wherein said feed and radiating network layer has a plurality of radiating elements arranged in an array, wherein said aperture layer has a plurality of apertures arranged in an array and respectively aligned with corresponding ones of said radiating elements and wherein said slot layer has a plurality of slots respectively aligned with corresponding ones of said radiating elements and corresponding ones of said apertures and wherein said method of compensating further includes configuring and arranging said slots in a predetermined fashion relative to said radiating elements so as to compensate for at least one of amplitude and phase errors.

12. The method of claim 11 wherein said configuring and arranging comprises selecting at least one of slot size, slot shape and slot position of one or more of said slots relative to said radiating elements.

13. The method of claim 11 and further including interposing an air dielectric layer between said backplane and said feed and radiating network layer.

14. The method of claim 13 and further including providing a radome coupled with said backplane and overlying said aperture layer, said slot layer and said feed and radiating network layer.

15. The method of claim 11 and further including providing a radome overlying said aperture layer, said slot layer and said feed and radiating network layer.

16. A method of compensating for errors in a radiating array for point-to-point communications, said array including a conductive backplane having a planar conductive surface, a generally planar feed and radiating network parallel to and spaced above said backplane surface, a generally planar slot layer parallel to and adjacent said feed and radiating network layer, and a planar aperture layer parallel and adjacent to said slot layer, wherein said feed and radiating network layer has a plurality of radiating elements arranged in an array, wherein said aperture layer has a plurality of apertures arranged in an array and respectively aligned with corresponding ones of said radiating elements and wherein said slot layer has a plurality of slots respectively aligned with corresponding ones of said radiating elements, said method comprising: configuring and arranging said slots in a predetermined fashion relative to said radiating elements so as to compensate for at least one of amplitude errors and phase errors.

17. The method of claim 16 wherein said configuring and arranging comprises selecting at least one of slot size, slot shape and slot position of one or more of said slots relative to said radiating elements.

18. The method of claim 16 and further including interposing an air dielectric layer between said backplane and said feed and radiating network layer.

19. The method of claim 16 and further including providing a radome overlying said aperture layer, said slot layer and said feed and radiating network layer.

* * * * *

UNITED STATES PATENT AND TRADEMARK OFFICE

CERTIFICATE OF CORRECTION

PATENT NO. : 6,411,258 B1
DATED : June 25, 2002
INVENTOR(S) : Jimmy Ho

It is certified that error appears in the above-identified patent and that said Letters Patent is hereby corrected as shown below:

Column 6,
Line 58, delete “claim 7” and insert -- claim 6 --.
Line 61, delete “claim 7” and insert -- claim 6 --.

Signed and Sealed this

Nineteenth Day of November, 2002

*Attest:*

*Attesting Officer*

JAMES E. ROGAN
*Director of the United States Patent and Trademark Office*